United States Patent [19]

Heathcock et al.

[11] Patent Number: 4,470,538

[45] Date of Patent: Sep. 11, 1984

[54] CARTON WITH COMMON TRAY-COVER COMPONENTS

[75] Inventors: J. H. Heathcock, Redmond; G. R. Pfieffer, Seattle, both of Wash.

[73] Assignee: Container Corporation of America, Chicago, Ill.

[21] Appl. No.: 510,670

[22] Filed: Jul. 5, 1983

[51] Int. Cl.[3] ..... B65D 5/32

[52] U.S. Cl. ..... 229/23 R; 229/30; 229/32; 229/44 R

[58] Field of Search ..... 229/23 R, 43, 44 R, 229/45 R, DIG. 11, 30, 31 R, 32; 220/4 E, DIG. 14

[56] References Cited

U.S. PATENT DOCUMENTS

| | | | |
|---|---|---|---|
| 3,027,062 | 3/1962 | Huss | 229/23 R |
| 3,827,624 | 8/1974 | Dogliotti | 229/44 R |

*Primary Examiner*—William Price
*Assistant Examiner*—Gary E. Elkins
*Attorney, Agent, or Firm*—Richard W. Carpenter

[57] ABSTRACT

A folding carton formed of a pair of identical, nestable, hingeable, interlockable, tray-like body-cover components.

1 Claim, 8 Drawing Figures

CARTON WITH COMMON TRAY-COVER COMPONENTS

BACKGROUND OF THE INVENTION

1. Field of the Invention

This invention relates generally to paperboard cartons and more particularly to a two-piece tray-type carton formed from separate but identical tray-shaped components which may be joined together in both hinged and latchable relationships.

2. Description of the Prior Art

A prior art search in the United States Patent and Trademark Office directed to the subject matter of this application disclosed the following U.S. Pat. Nos. Des. 219,132; Des. 222,786; Des. 225,512; Des. 230,569; Des. 236,692; Des. 241,820; Des. 241,821; Des. 241,822; Des. 244,833; Des. 245,579; Des. 256,097; Des. 263,684; Des. 263,798; 265,589; 1,251,921; 1,367,356; 1,950,934; 2,771,986; 2,898,028; 2,917,218; 3,013,711; 3,038,650; 3,315,796; 3,338,468; 3,412,888; 3,511,433; 3,576,271; 3,827,624;* 3,876,130; 3,968,921; 3,968,922; 4,013,214; 4,132,344; 4,143,805; 4,226,358; 4,266,713* 4,232,816; 4,294,371; 4,360,147.

None of the prior art patents uncovered in the search discloses a tray-type container and a cover formed from two identical, nestable, hingeable, interlockable components.

SUMMARY OF THE INVENTION

An object of the present invention is to provide a folding carton having separate tray and cover members which may be hingedly attached to each other and also joined to each other in latchable relationship.

A more specific object of the invention is the provision, in a carton of the type described, of separate components which are identical and can be used to form either the tray or cover portions of the carton.

Another specific object of the invention is to provide a combination body-cover component that is completely nestable and stackable with similar components.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 6:
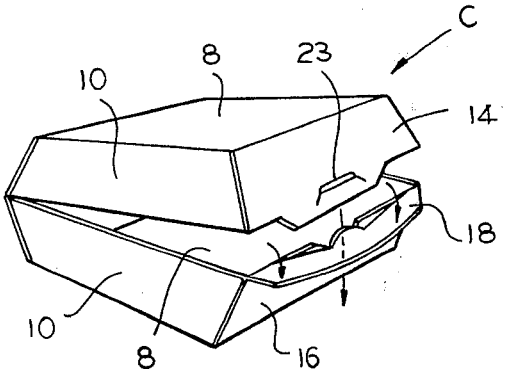
FIG. 6 is a perspective view of a carton shown in the nearly closed position.
Figure 7:
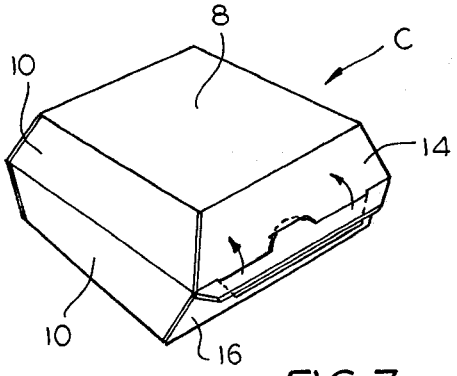
FIGS. 7 and 8 are views similar to FIG. 6 but illustrate the manner in which the carton components are latched in interlocking relationship to close the carton.
Figure 8:
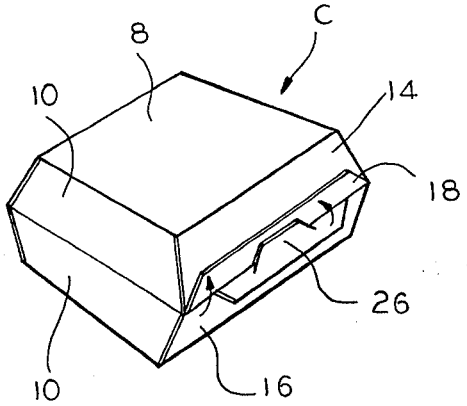

Referring now to the drawings for a better understanding of the invention it will be seen that the novel carton, indicated at C in FIGS. 6–8, may be formed from a pair of identical combination body-cover members, indicated generally at TL.

Figure 1:
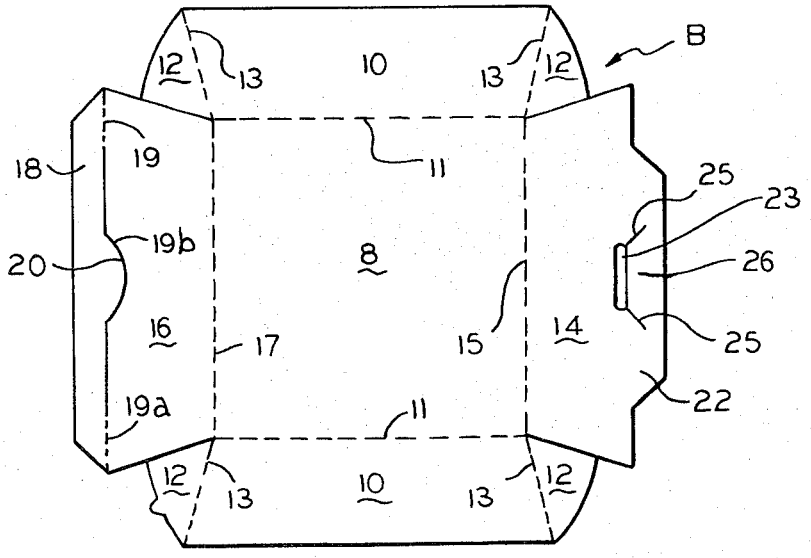
FIG. 1 is a plan view of a blank of foldable sheet material, such as paperboard, from which the carton components illustrated in the other views may be formed.

Each of the body-cover members TL may be formed from a unitary blank B of foldable sheet material, such as paperboard, illustrated in FIG. 1.

Figure 2:
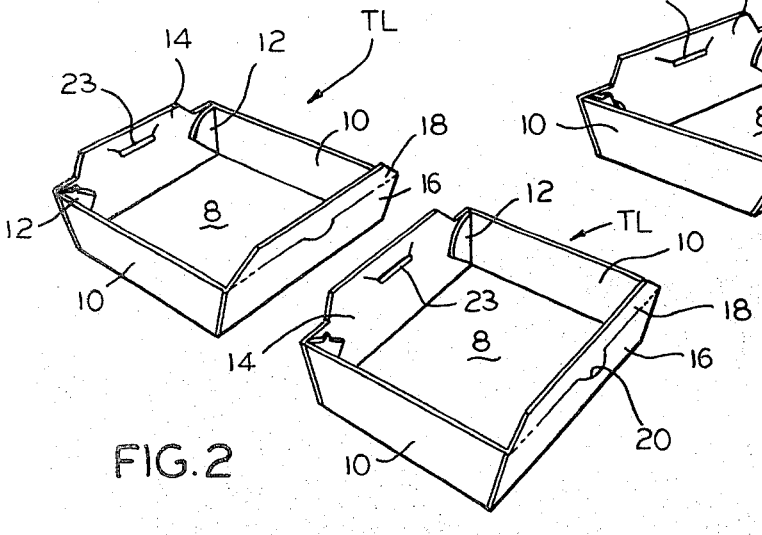
FIG. 2 is a perspective view illustrating the identical body-cover components of the carton embodying features of the invention, in the position they are placed prior to attachment to each other.
Figure 4:
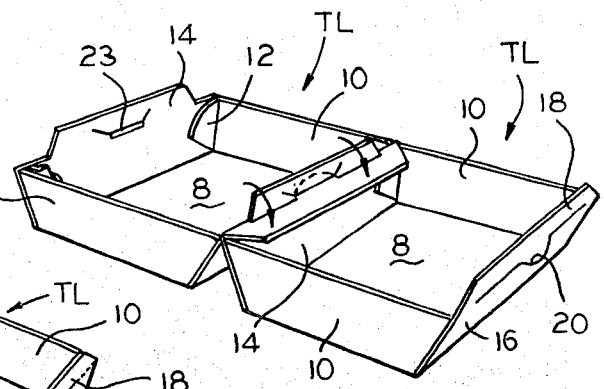
FIGS. 3, 4 and 5 are views similar to FIG. 2 and illustrate the manner in which the two components are joined to each other.
Figure 3:
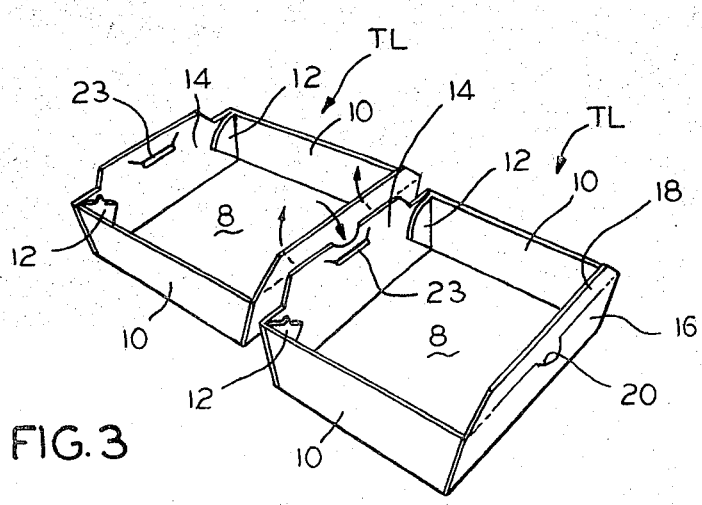
Figure 5:
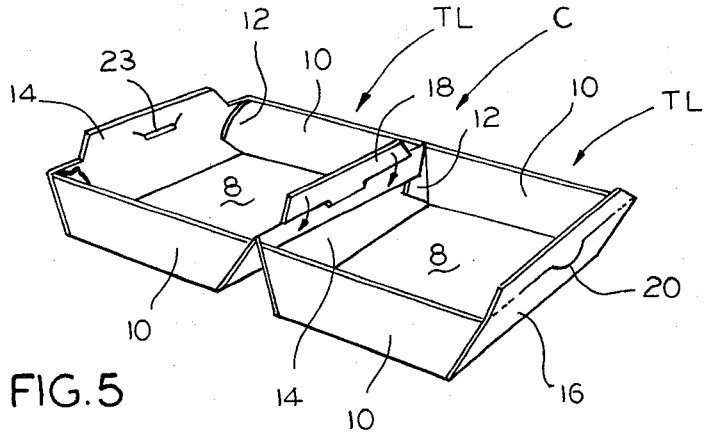

Referring now to FIGS. 1 and 2, it will be seen that each body-cover component TL includes a generally rectangular main panel 8 having a pair of end panels 10 foldably joined on fold lines 11 to end edges thereof. Each of the end panels 10 is provided at opposite ends thereof with corner flaps 12 which are foldably joined to the end edges thereof, along fold lines 13, and adapted to be adhesively secured to adjacent portions of respective side panels.

Also, joined to the front and rear side edges of main panel 8 on fold lines 15 and 17, respectively, are a pair of first and second side panels 14 and 16.

Second side panel 16 is provided with a locking flap 18 which is foldably joined to the upper edge of second side panel 16 along spaced fold lines **19*a*. Intermediate the fold lines 19*a* there is a cut line 19*b* which forms a slit 19** between the flap and the panel. The purpose of the slit is described later in the specification.

It will be noted that cut line **19*b* is bowed toward panel 16 to form a projection or lock tongue 20**, the purpose of which is also described later in the specification.

Turning now to first side panel 14, it will be seen that the central portion thereof has an upwardly extending projection 22 which is provided with a slit or hole 23. Adjacent the hole there are a pair of downwardly converging slits 25 which define therebetween a lock tab 26.

It will be understood that, because of the sloping side and end panels of the carton components TL, they may be stacked or nested one inside the other to occupy a minimum amount of space.

Also, by providing a carton formed from identical components the number of problems associated with the inventory of components is greatly reduced.

In assemblying the carton, as best seen in FIGS. 3–6, the hinge connection is formed first. This is accomplished by passing first side panel projection 22 through slit 19 in locking flap 18 and then bending over the locking flap until lock tongue 20 extends through opening 23 in extension 22. At this point the carton is in the form of a tray with a hinged cover, as shown in FIGS. 3, 4, 5, and 6.

In order to provide an interlockable or latchable connection between the other sides of the carton components, projection 22 on the cover is passed through the slit 19 in the locking flap 18 of the body, and then the locking flap is rotated upwardly until lock tongue 20 extends into the opening 23 in front of lock tab 26. Thus, there is provided a positive hinging arrangement and a positive latching arrangement between two identical components.

What is claimed is:

1. A combination body-cover member for use with another identical, nestable, hingeable, interlockable, body-cover member to form a tray-like, coverable carton, said members each being formed of a unitary blank of foldable sheet material, such as paperboard, and comprising:

(a) a main panel having first and second side panels and end panels foldably joined to side and end edges thereof, and to each other, and extending from said main panel to form therewith a tray-like structure;

(b) said first side panel having, intermediate the ends thereof, a projection extending away from said main panel and including:

(i) a lock tongue receiving aperture therein;

(ii) a lock tab adjacent said aperture extending toward said main wall panel;

(c) said second side panel having foldably joined to an edge thereof a locking flap;

(d) said locking flap including:

(i) a central portion separated from said second side panel by a slit adapted to receive said first side panel projection;

(ii) a locking tongue adjacent said slit extending toward said side panel;

(e) said first side panel projection of a body member being adapted to be passed through said second side panel slit of a cover member, and said second side panel locking tongue of the cover member being adapted to be bent under said first side panel receiving aperture of the body member to form a hinge connection; and (f) said first side panel projection of the cover member being adapted to be passed through said second panel slit of the body member, and said second side panel locking tongue of the body member being adapted to be bent under said first side panel receiving aperture of the cover member to form an interlockable connection.

* * * * *